United States Patent [19]

Kubelka

[11] 4,124,223

[45] Nov. 7, 1978

[54] SKI BRAKE

[75] Inventor: Axel R. Kubelka, Vienna, Austria

[73] Assignee: TMC Corporation, Baar, Switzerland

[21] Appl. No.: 762,751

[22] Filed: Jan. 26, 1977

[30] Foreign Application Priority Data

Jan. 28, 1976 [AT] Austria ..... 601/76

[51] Int. Cl.[2] ..... A63C 7/10

[52] U.S. Cl. ..... 280/605

[58] Field of Search ..... 280/605, 604

[56] References Cited

U.S. PATENT DOCUMENTS 3,917,297 11/1975 Fruh ..... 280/605

3,989,271 11/1976 Rieder ..... 280/605

FOREIGN PATENT DOCUMENTS 608,070 1/1935 Fed. Rep. of Germany ..... 280/605

984,272 7/1951 France ..... 280/605

60,417 1/1939 Norway ..... 280/605

*Primary Examiner*—David M. Mitchell

*Attorney, Agent, or Firm*—Blanchard, Flynn, Thiel, Boutell & Tanis

[57] ABSTRACT

A ski brake having a transverse carrier pivotally supported on a ski, which transverse carrier has braking legs which extend perpendicularly with respect to the longitudinal axis of the ski and are arranged at the sides of the ski and can be pivoted into and out of the braking position under spring urging. When the legs are in the braking position, they project substantially perpendicularly downwardly from the ski. The axis of rotation of the transverse carrier is supported on a holding member resiliently mounted on to the ski and effects a resilient holding of the axis of rotation at least in the braking position above and away from the upper surface of the ski.

12 Claims, 10 Drawing Figures

SKI BRAKE

FIELD OF THE INVENTION

The invention relates to a ski brake having a pivotally supported holding member with a transverse carrier which lies perpendicularly with respect to the longitudinal axis of the ski, the two legs of which transverse carrier are arranged at the sides of the ski and are pivotal under spring action into a braking position so that the legs project substantially perpendicularly from the ski downwardly.

BACKGROUND OF THE INVENTION

A ski brake of the abovementioned type is for example described in Austrian Patent No. 305 847. In this known ski brake, the legs are hinged to pins which are arranged on the sidewalls of the ski and one or several tension springs are secured at one end to the leg and at the other end eccentrically to the pin. The known construction has the disadvantage that the legs project not only in the braking position, but also in the cocked or ready position, namely in the retracted position, outwardly from the sides of the ski. This has the disadvantage that the front ends of the legs can get caught or snagged in obstacles which project from the ground.

A ski brake is also known in which the legs can be retracted above the ski surface in the cocked or ready position. Such a device is described for example in German OS No. 2 412 623, published Nov. 13, 1975. This construction has in turn the disadvantage that the legs, which consist of a spring wire, can be easily deformed when the wire is not very strongly dimensioned; however, in the case of legs which consist of a strong spring wire, the correct mode of operation is endangered.

However, an improved construction of the aforementioned ski brake has become already known; here, however, the further disadvantage of the aforedescribed construction still exists, namely that pulling in of the legs is accomplished only by extending the wire bar part. Due to this operation the legs can get caught during a pivoting of the transverse carrier.

The purpose of the invention is to overcome these disadvantages and to design a ski brake of the abovementioned type in such a manner that the pivoting or the pulling-in movements are clearly separated from one another. A further purpose is that the parts which must be made of spring wire be reduced as much as possible.

The set purpose is inventively attained by supporting the axis of rotation of the transverse carrier on a holding member which is secured on the ski, which holding member resiliently holds the axis, at least in the braking position of the ski brake, above and away from the ski surface.

All goals are clearly achieved by the inventive design of the ski brake. The transverse axis which is spaced at a certain height above the ski surface first permits a pivoting of the member carrying the legs to a position where the legs are safely above the ski surface. Therefore, and during a movement of the leg carrying member toward a fully retracted position, the legs are moved inwardly toward each other, over the upper surface of the ski. If the ski brake is released, then the holding member with the axis of rotation swings upwardly earlier, prior to the legs arriving at the sides of the ski so that a jamming of the legs cannot occur. The separate springy construction of the holding member assures furthermore an independent adjusting of the springy parts for the legs and for the holding member, so that the dimensioning can be accomplished corresponding with the respective requirements.

Further advantages and details of the invention will be discussed more in detail in connection with the drawings, which illustrate some exemplary embodiments.

BRIEF DESCRIPTION OF THE DRAWINGS

In the drawings:

FIGS. 1 to 4 illustrate a first exemplary embodiment, wherein

FIG. 1 is a side view,

FIG. 2 is a top view,

FIG. 3 is a front view and

FIG. 4 is a perspective view,

FIGS. 5 and 6 illustrate a further exemplary embodiment, wherein FIG. 5 is a front view and FIG. 6 is a perspective view, FIGS. 7 to 10 illustrate a further exemplary embodiment, wherein FIG. 7 is a side view with the brake legs extending in the braking position, FIG. 8 is a side view with brake legs extending in the cocked or ready position, FIG. 9 is a front view and FIG. 10 illustrates the ski brake during cocking by a ski boot in connection with a front jaw.

DETAILED DESCRIPTION

Figure 1:
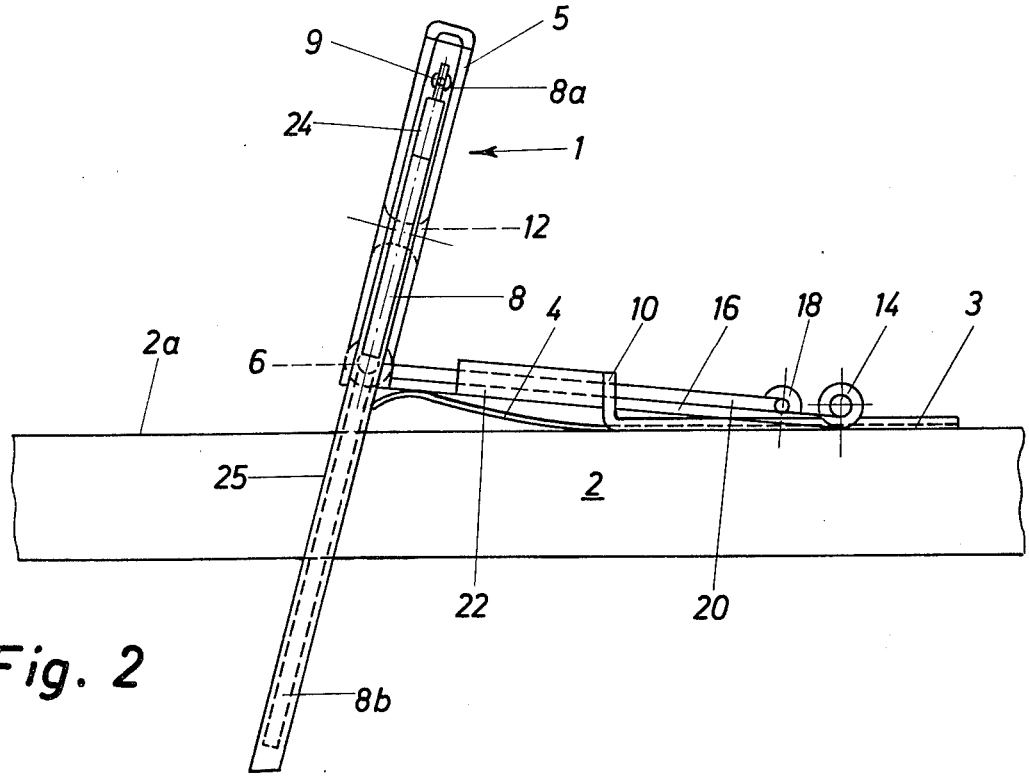
Figure 2:
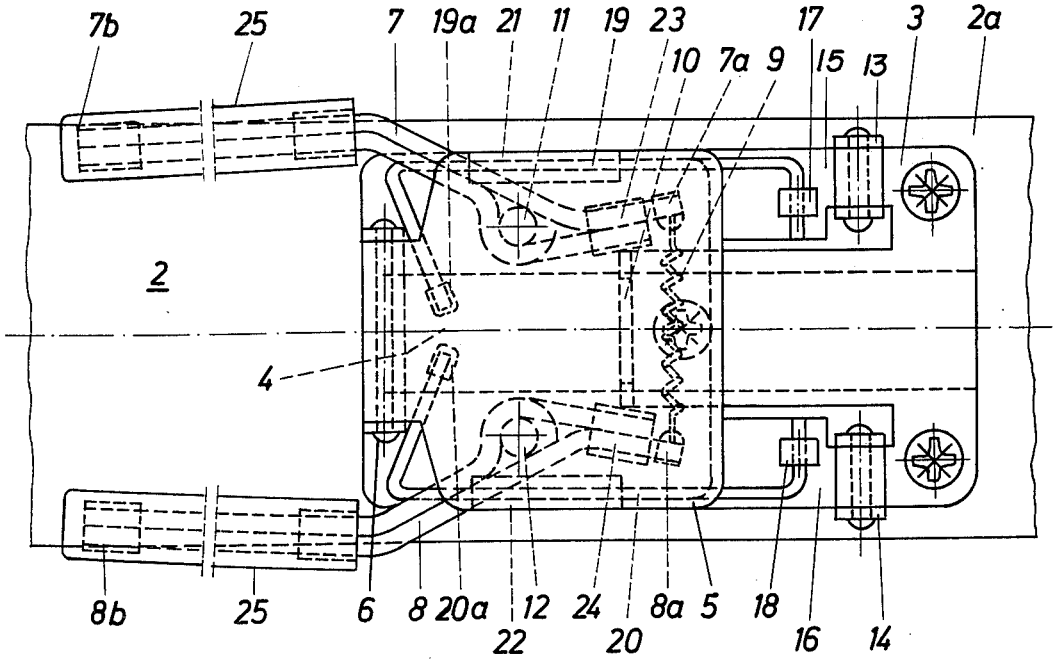
Figure 4:
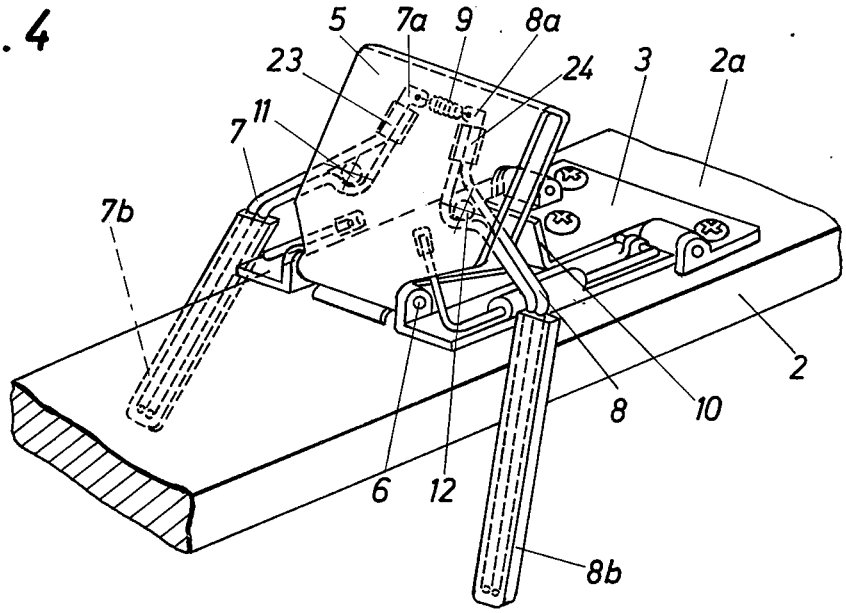

The inventive ski brake 1 is urged above and away from the surface 2*a* of the ski 2 by means of a holding part 3 which is secured on the ski 2 and which is loaded by a spring 4. The actual brake mechanism of the ski brake 1 includes a hollow transverse carrier 5 which can be pivoted about an axis of rotation 6 which extends transversely with respect to the longitudinal axis of the ski. The two brake legs 7,8 are connected to the transverse carrier 5 such that the upper free ends 7*a*, 8*a* of the two legs 7,8 which lie inside of the transverse carrier 5, are held together or urged toward each other by means of a spring 9. The legs 7,8 each have a loop formed therein and are each pivotally supported about a pin 11 or 12 which is riveted on both sides to the transverse carrier 5 and received in the loop. A generally upwardly tapering, wedge-shaped crossbar 10 is mounted on the holding part concentric with respect to the two legs 7,8. The crossbar 10 effects during a pivoting of the transverse carrier 5 in direction of the ski 2 a spreading apart of the two legs 7,8 when the center area of the same comes under the action of the bar 10 and against the force of the spring 9. A comparison of FIGS. 2 and 4 well permits the recognition of the operation of the bar 10. It can also be seen and it is also understandable that as soon as the spreading apart of the ends 7*a*,8*a* of the legs 7,8 occurs, the two other ends 7*b*,8*b* of the legs 7,8 move toward one another and finally assume the position which is shown in FIG. 2. From FIG. 2 it can also be seen that the legs 7,8 extend in the cocked or ready position substantially above the surface 2*a* of the ski 2 so that any kind of snagging on objects projecting from or out of the ground is avoided.

As can be taken from FIGS. 1 to 4, the holding part 3 has several functions. First it serves to secure the ski brake 1 to the ski 2. Furthermore a spreading of the legs 7,8 is effected through the bar 10. Finally this part also provides a resilient mounting. For this purpose the holding part 3 has at its end zone which is opposite to the axis of rotation 6 two bearings 13,14 in which swivel holding members 15,16 are pivotally supported. Further supports 17,18 are mounted on the two swivel holding members 15,16 and bent torsion rods 19,20 are anchored therein. These torsion rods effect the pivoting of the transverse carrier 5 with the legs 7,8 into the braking position when the ski brake 1 is released from the boot. The front ends of the two rods 19,20 are for this purpose also bent and secured in the intermediate space of the double-wall transverse carrier 5. To longitudinally guide the rods 19,20, guideways 21,22 are arranged on the lateral areas of the swingable holding members 15,16. The torsion rods 19,20 have at their ends which are associated with and located inside the transverse carrier 5 low friction caps or, sliding feet **19*a*,20*a* or the like which reduce the friction. As can particularly be taken from FIGS. 2 to 4, the legs 7,8 of the actual brake part of the ski brake 1 are made of a double spring material wherein the bent-back free ends of the wire material are held together by means of a clamp 23,24. The free-standing ends or ends zones of the legs 7,8 have as is actually known coverings 25** made of, for example, plastic.

Figure 5:
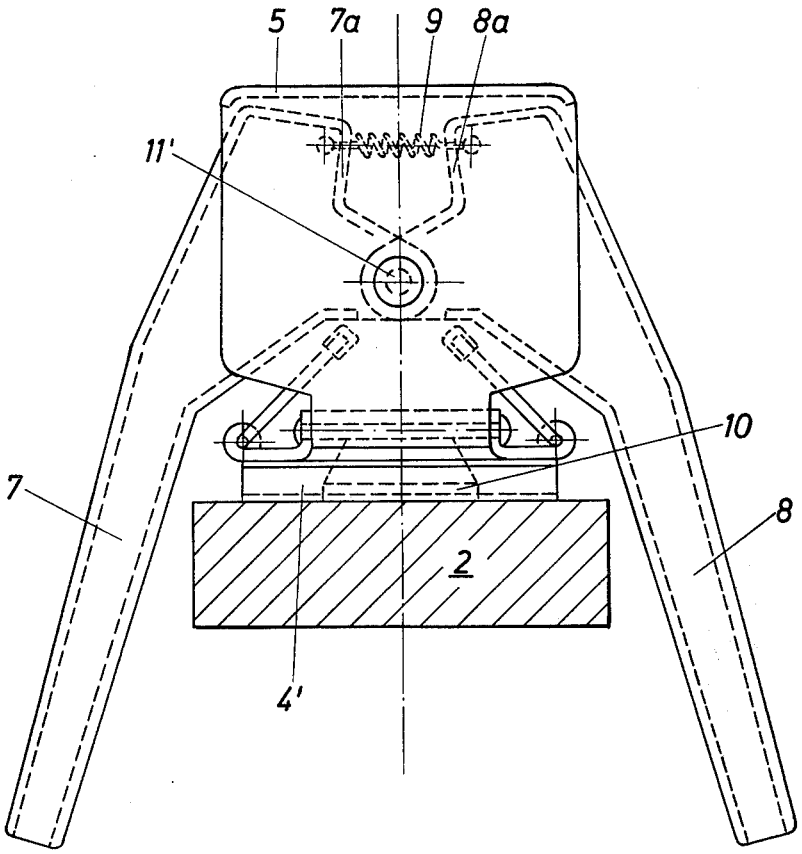
Figure 6:
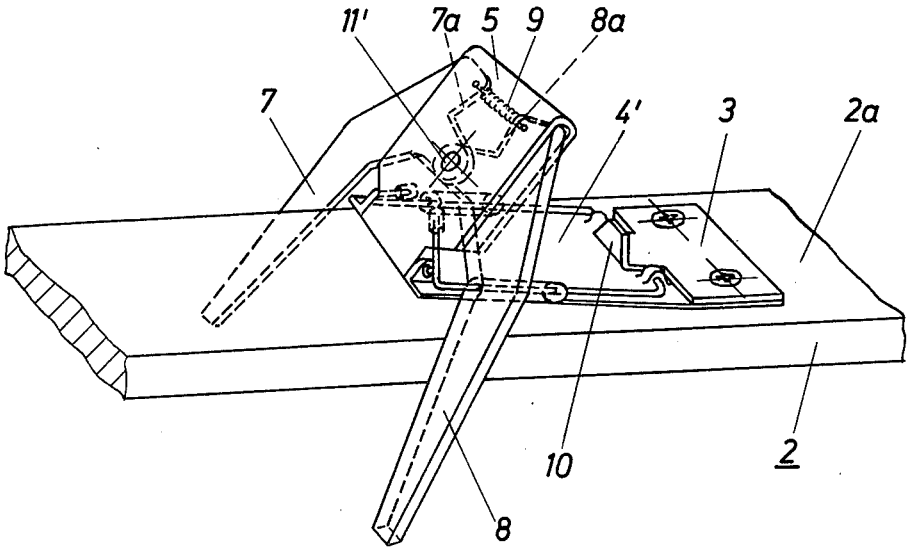
Figure 7:
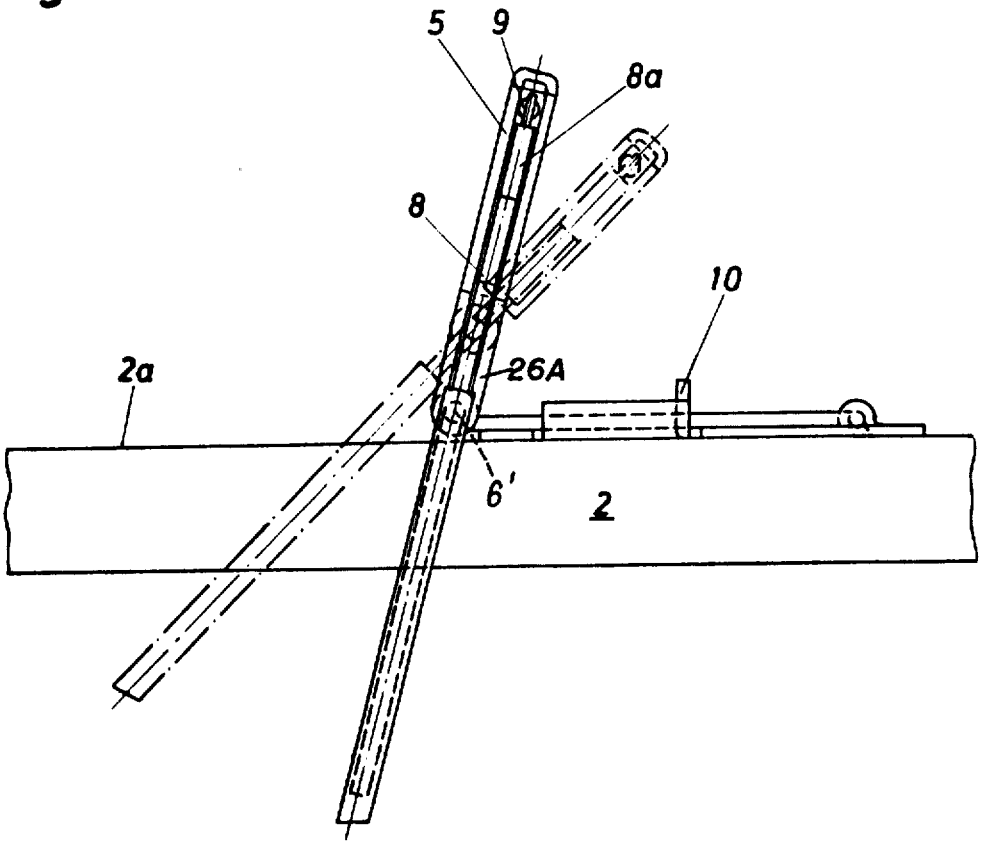
Figure 8:
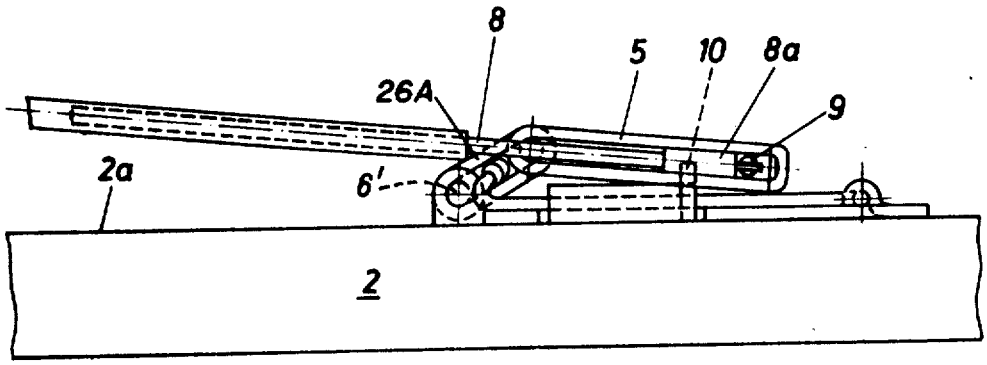

The exemplary embodiment according to FIGS. 5 and 6 differ from the exemplary embodiment according to FIGS. 1 to 4 substantially only in the change of the swingable mounting which is associated with the holding part 3 and the design of the legs. Therefore, the following description is limited to information regarding these parts.

As is particularly illustrated in FIG. 6, the swingable mounting which is associated with the holding part 3 is designed itself as a leaf spring 4'. This design is advantageous for reasons of manufacture, since the separate construction of swingable mountings and at least one additional spring which loads said mountings can be eliminated. Further details correspond substantially to the already described construction, even if dimensions and some details are different. For the purpose of better understanding, reference may in spite of it be made to the present embodiments.

The changed construction of the legs permits the use of one single common riveted holding pin 11' around which the common part of the two leg parts are wound and wherein the two free wire ends are received in the transverse carrier 5. In spite of the changed construction, the areas **7*a*,8*a* of the legs 7,8 which are held together by means of the spring 9 effect the already discussed pivoting movement, namely on the one hand the pulling together due to the action of the mentioned spring 9 and, on the other hand, the spreading apart due to the action of the bar 10 on the holding part 3. From FIGS. 5 and 6 it can be clearly recognized that spreading apart occurs only when the areas 7*a*,8*a* of the legs 7,8 come under the action of the bar 10. Thus the possibility also exists that through the construction, positioning and through a determining of the angular position of the bar 10**, both the point in time and also the degree of spreading apart can be regulated. In this exists a substantial advantage of the inventive ski brake, because the mentioned operations can be designed separate from other movements, in particular from the swinging movement of the legs.

As is generally known, such ski brakes are mounted on the ski in such a manner that the holding bar is pressed down by the heel of the boot. The known common construction has of course also disadvantages in that the skier must cause a pressing down of the legs when he is already in the front jaw with the toe of the boot. A further thought of the invention lies in designing the ski brake so that same can be pressed down by the boot sole, in other words, so that the ski brake is arranged in the front area of the ski binding. This embodiment has the further advantage that one can do without the special holding part, or at least a part of same, assuming that the ski brake is integrally arranged on the ski with the front jaw. Details of this embodiment will now be described as follows.

As can be recognized from FIGS. 7 to 10, the ski brake 1', which is constructed from known parts, is constructed in a similar manner, as is described in connection with the present embodiments. However, an important difference consists in the transverse carrier 5 being secured on a mounting 26 which in turn is supported for movement on a holding member 26 about the pivot axis 6. Therefore, this construction has two pivot axes. One pivot axis is the already mentioned axis of rotation 6' and the other pivot axis is formed by two rivet type bolts 27,28 which hold the parts of the mounting 26 together. This embodiment permits, therefore, on the one hand a pivoting of the entire ski brake 1 about the pivot axis 6 and, on the other hand, a pivoting of the transverse carrier 5 about the rivet type bolts 27,28 relative to the holding member 26A. In this manner it is achieved that during a stepping down on the transverse carrier 5 (compare FIG. 10) first the two legs 7,8 still exist next to the sidewalls of the ski 2, however, in a position which easily permits a pulling in of the legs 7,8. This pulling in is accomplished in the already described manner by a further stepping down on the transverse carrier 5 causing the spreading apart of the resilient ends **7*a*,8*a* of the legs 7,8 to cause the legs to be pulled in or retracted over the upper surface of the ski. The spreading apart is accomplished also in this case under the action of the bar 10. The springiness of the mounting 26 is constructed in a similar manner, as is described in connection with the exemplary embodiment according to FIGS. 1 to 4. A spring element 29 is arranged between transverse carrier 5 and the mounting 26 on the holding member 26A**.

The invention is not limited to the illustrated exemplary embodiments. Further variations are possible without departing from the scope of the invention. For example, described embodiments can be varied among one another. However, it is also possible to render the crossbar adjustable so that the ski brake can be adjusted to different width of skis. In this case only the length of the pivot axis 6 need be changed. This can, however, also be accomplished by constructing the pivot axis in two parts with the two parts threadedly engaging one another. If necessary, the two axis parts can be connected by means of a pin.

Three different forms have already been given for the construction of the legs. However, it is also conceivable to replace the shown spring with a different elastic device, for example, with a pneumatic and/or hydraulic device. It is also not necessary to provide the legs with a plastic cover. Other materials, for example, a sheet metal covering or a leather covering can also be used. As shown in FIG. 6, the legs can also be manufactured of a single material; in this case the covering can be omitted entirely. Principally it is also possible to use a pressure spring in the area of the legs, which area is opposite in relation to the pin 11. Both for reasons of manufacture and also for practical reasons, however, the use of a pull spring, as described, is preferred.

The spring which loads the holding part 3 or its holding members 15,16 can also be designed differently, for example in form of plate springs or in the form of an elastic support of rubber, for example. In determing the elasticity, on the one hand, the mounting for the axis of rotation at a certain level above the ski surface and, on the other hand, the compressibility of the elastic member are of importance. The latter in order to create a structural height of the ski brake is to be as small as possible.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a ski brake having a holding member and first pivot means for pivotally securing said holding member to a ski for movement about a first axis transverse of the longitudinal axis of said ski, a transverse carrier extending perpendicularly with respect to the longitudinal axis of the ski, second pivot means for pivotally securing said transverse carrier to said holding member for movement about a second axis parallel to said first axis, said transverse carrier having two legs arranged at the sides of said ski, said transverse carrier and said legs being movable about said second axis between a retracted position wherein said legs are positioned above the upper surface of said ski and a braking position wherein the free ends of said legs project substantially perpendicularly downwardly below the bottom surface of said ski, the improvement comprising wherein said first pivot means includes a holding part secured to said ski and wherein resilient means yieldingly urges the end of said holding member remote from said first pivot axis, at least in the braking position of said legs, above and away from the upper surface of said ski and support means supporting said legs for movement relative to said transverse carrier and so that said free ends of said legs move laterally of said longitudinal axis of said ski between positions alongside of and over the top of said ski.

2. The improved ski brake according to claim 1, wherein said resilient means includes a spring yieldingly engaging and cooperating with said holding member at a location remote from said first pivot axis.

3. The improved ski brake according to claim 1, wherein said holding member has at least one bent torsion rod anchored thereon with one end being resiliently flexible and slidingly engaging said transverse carrier to urge said transverse carrier into said braking position.

4. The improved ski brake according to claim 3, wherein said one end of said torsion rod has a low friction covering for reducing the frictional engagement with said transverse carrier.

5. The improved ski brake according to claim 1, wherein said legs of said transverse carrier consist of a wire spring material, wherein said support means includes third pivot means on said transverse carrier for pivotally supporting said legs on said transverse carrier, and a spring being secured to and extending between the ends of said legs remote from said free ends and which project upwardly in said braking position above the upper surface of said ski for holding said ends of said two legs together, said spring being dimensioned corresponding with the safe swinging back of the legs to said position alongside of said ski.

6. The improved ski brake according to claim 5, wherein said holding part has a wedge-shaped crossbar projecting upwardly therefrom and wherein as said carrier pivots toward said holding member said ends of said two legs are pivotal into engagement with said crossbar to effect a spreading of said ends when said legs are in said retracted position above the upper surface of said ski.

7. The improved ski brake according to claim 1, wherein said transverse carrier extends upwardly from said second pivot axis and said legs extend downwardly from said second pivot axis when said legs are in said braking position.

8. The improved ski brake according to claim 1, wherein said two legs consist of one single, spring wire having two free ends, wherein said support means includes one single holding pin, the center part of said spring wire being wound around said single holding pin and said two free wire ends engage said transverse carrier.

9. The improved ski brake according to claim 1, wherein said two legs each consist of sheet metal, wherein said support means includes a single pivot pin, said sheet metal being pivotally connected to said transverse carrier by said single pivot pin.

10. The improved ski brake according to claim 1, wherein said holding part has a wedge-shaped crossbar projecting upwardly therefrom.

11. The improved ski brake according to claim 1, wherein said resilient means includes at least one bent torsion rod mounted on said holding part with one end being resiliently flexible and slidingly engaging said holding member and wherein the elevated second pivot axis on said holding member is formed by pin means on said holding member and including a spring element between said holding member and said transverse carrier for urging an aligned relation therebetween.

12. The improved ski brake according to claim 11, wherein said first pivot axis is defined by a pivot pin, said pivot pin pivotally securing said holding part to said holding member.

* * * * *

UNITED STATES PATENT AND TRADEMARK OFFICE

CERTIFICATE OF CORRECTION

PATENT NO. : 4 124 223

DATED : November 7, 1978

INVENTOR(S) : Axel R. Kubelka

Figure 7:
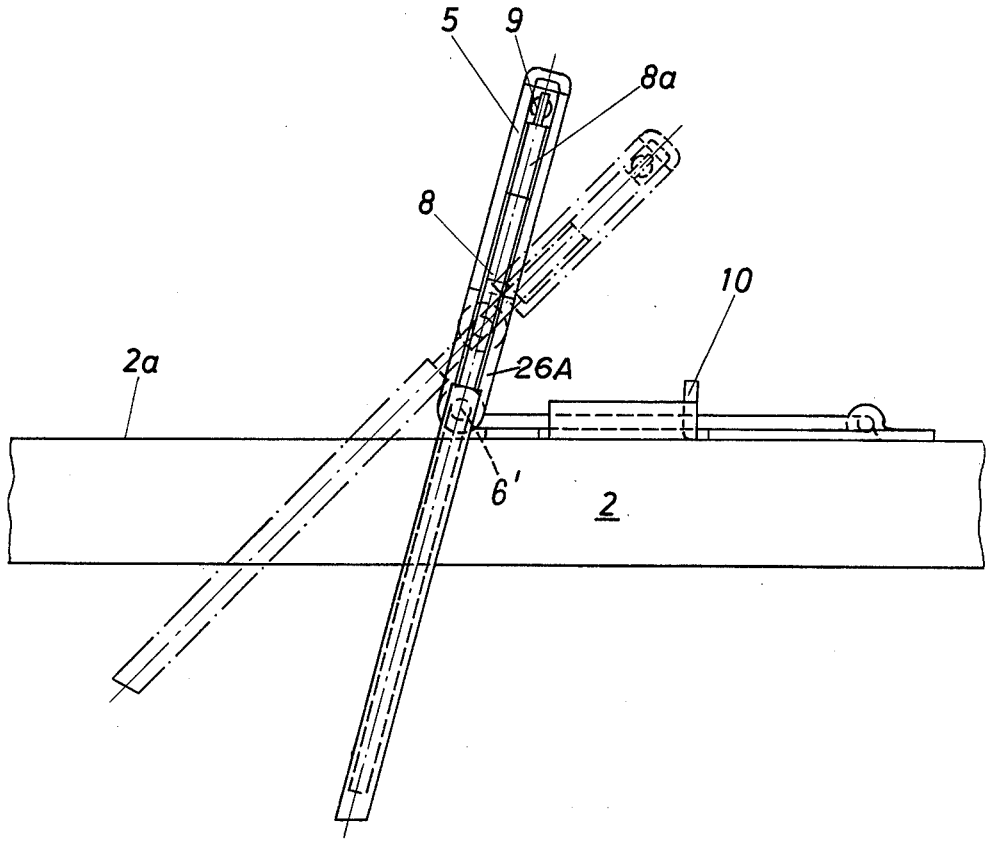
Figure 8:
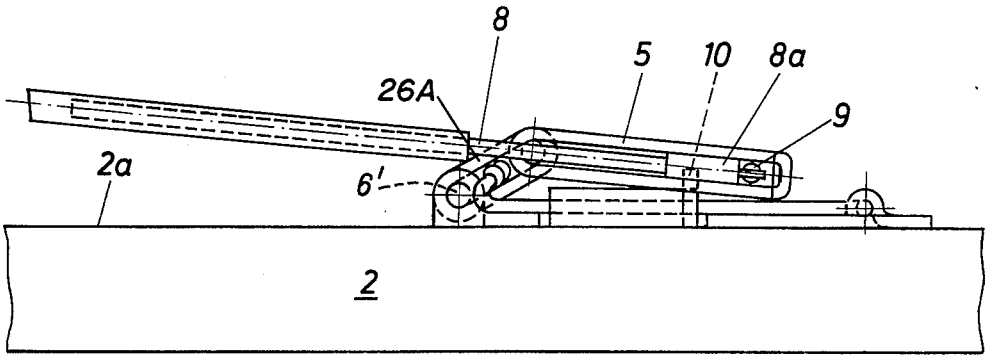
Figure 9:
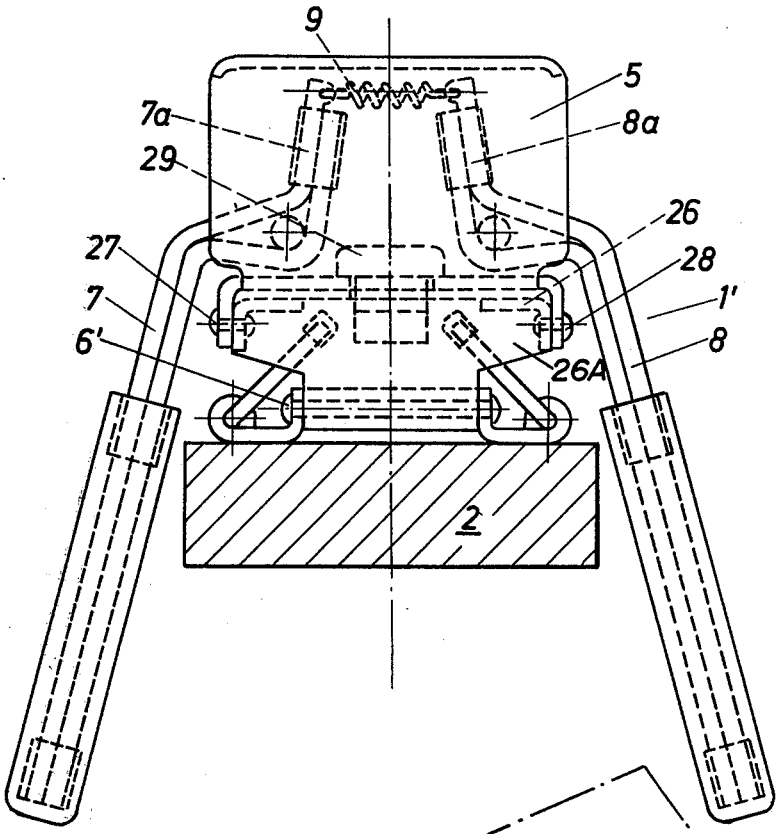
Figure 10:
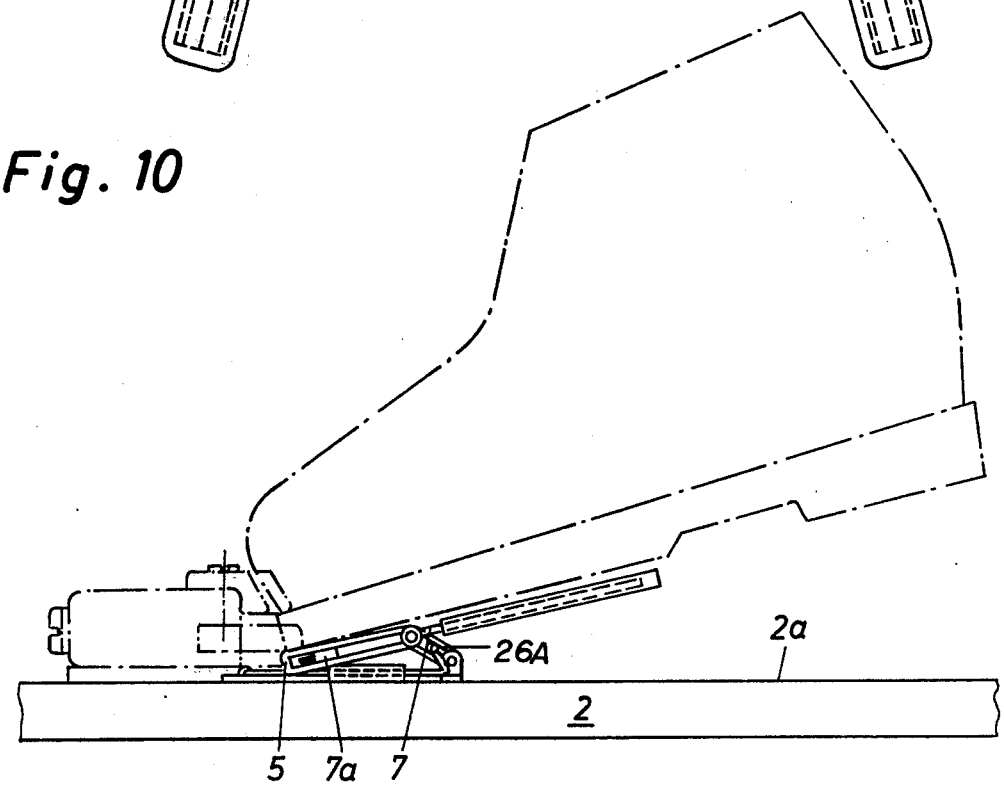
Figure 3:
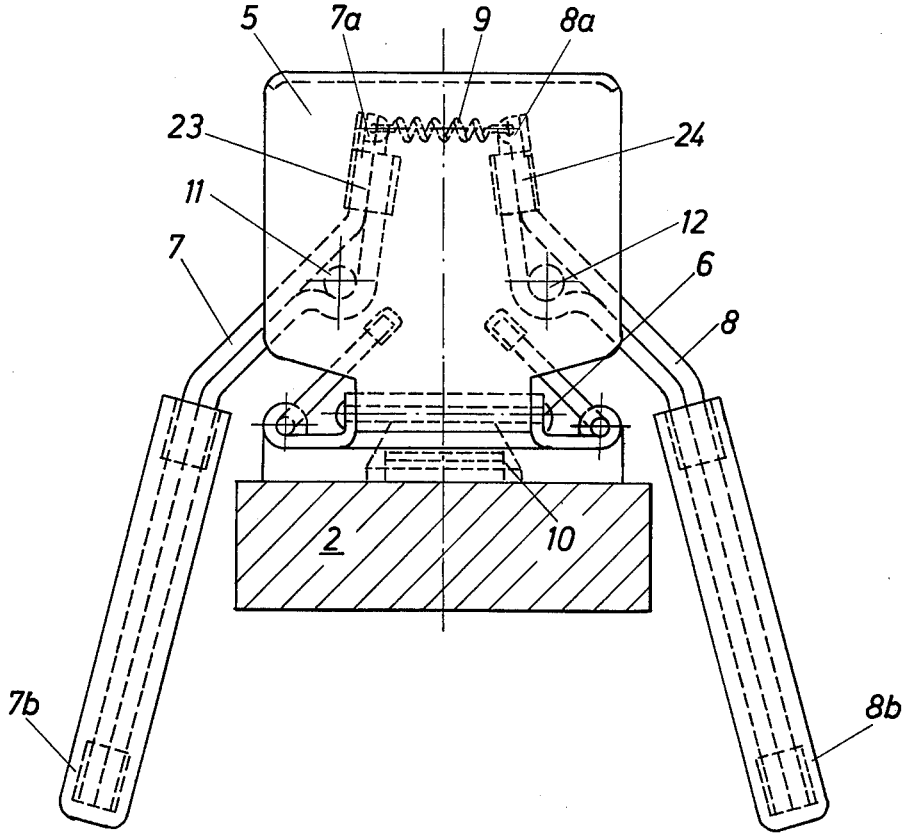

It is certified that error appears in the above-identified patent and that said Letters Patent are hereby corrected as shown below:

The patent is being amended by the addition of Figures 7 and 8.

This certificate applys to the Grant, exclusively.

Signed and Sealed this

*Twenty-second* Day of *May 1979*

[SEAL]

*Attest:*

RUTH C. MASON
*Attesting Officer*

DONALD W. BANNER
*Commissioner of Patents and Trademarks*